United States Patent [19]

Bunting

[11] Patent Number: 5,033,752

[45] Date of Patent: Jul. 23, 1991

[54] BOARD GAME TO CATCH A THIEF

[76] Inventor: Vivian M. Bunting, c/o Shallcross Creations Limited, 7 Margaretta Terr., London SW1 5NU, England

[21] Appl. No.: 543,085

[22] Filed: Jun. 25, 1990

[51] Int. Cl.[5] ..... A63F 3/00

[52] U.S. Cl. ..... 273/251; 273/263

[58] Field of Search ..... 273/249, 243, 263, 250–254

[56] References Cited

U.S. PATENT DOCUMENTS

| | | | |
|---|---|---|---|
| 1,349,615 | 8/1920 | Koellhoffer | 273/263 |
| 1,674,791 | 6/1928 | Patocka | 273/243 |
| 2,780,463 | 2/1957 | Salomon | 273/249 |
| 4,053,154 | 10/1977 | Niemann | 273/243 |
| 4,890,843 | 1/1990 | Chauve | 273/246 |
| 4,946,168 | 8/1990 | Fauls | 273/241 |

FOREIGN PATENT DOCUMENTS

| | | | |
|---|---|---|---|
| 586817 | 4/1947 | United Kingdom | 273/243 |

*Primary Examiner*—Benjamin Layno

*Attorney, Agent, or Firm*—Nixon & Vanderhye

[57] ABSTRACT

A board game involving plural players moving plural pairs of masked ball player piece characters in accordance with directions produced by at least two sets of chancge elements such as cards wherein the directions direct the players to move one or more characters in a particular manner along a progressive path or to and from sections of the board adjoining the progressive path and wherein one of the masked characters moved by one of the players is known to at least that player as being a jewel thief. The object of the game for the player moving the thief game piece is to move the thief to the last place on the path which leads to escape and winning the game, whereas, the object for opposing players is that of apprehending the thief before escape.

18 Claims, 19 Drawing Sheets

One who knows

Dance once more around the floor.
(Make one complete circuit).
May be used twice.

One who knows

In the passageway, leading to the dungeons, beware of the seventh cell! When the thief brushes against the bars, they will spring open and entrap him. Thus, when he reaches the exit, he must move back to the nearest yellow space.

One who knows

Throughout the Chateau there are many peep holes, and you saw the thief steal the jewel. You may look at each of the other players' thief cards.
(But you still have to catch him!)

One who knows

Only you know that the door leading to the escape tunnel is locked. When the thief reaches it, he is trapped!
You win the game!

One who knows

A detective is hiding in the maze, listening and observing. You may use this card once to require all characters in any one of the rooms to confess without penalty.

One who knows

There is a secret passageway leading to the exit behind the wall of mirrors in the Diamond Room. Your characters have found the false mirror, which opens at a touch, and may use it to leave that room without payment throughout the game.

One who knows

You will find in the Cardroom on the highest shelf, in the darkest corner, a book on magic, open it and discover the name of the thief. Use this card to require the player whom you suspect to confess. Demand three diamonds from him not to reveal the guilty character.

One who knows

You found a clue under the Sundial in the Garden. You may use it to challenge, without penalty, any character on the board.
This card may be used twice

One who knows

Move a pair of your characters to the first space in the inner circle and see if the thief hides there. You may use this card once to challenge one suspect in the inner circle, without penalty.

One who knows

Demand that each of the other players give you three "Diamonds".
(To be used only once during the game).

One who knows

You alone can use this card to move a pair of characters to the brown space in the inner circle if you think the thief is getting away.

FIG. 4

Clue

FOR THE PURSUER
Hold the lantern high and you will find a "Priest's Hole" behind the panel. You may insist that any one character in the Card Room confesses whether he is the thief. But you still have to catch him. No sum need be paid in restitution.

Clue

FOR THE PURSUER
Whispers can be heard along the Minstrels' Gallery. Throughout the game you may require every character on a red space to confess whether he is the thief. But you still have to catch him!

Clue

FOR THE THIEF
When you reach the end of a dark passage, you will see steps leading under the moat.
Use this card to take an extra turn at any time.
(To be used only once).

Clue

FOR THE PURSUER
The Green Bamboo
Says that you should slither to the first green space in the inner circle.
(To be used only once).

Clue

MAGIC MOON
For the thief — "I will dim my light till you're out of sight".
Once in the inner circle, using this card, you may escape on any move forward, equal to or greater than the precise number of steps leading to the centre space.

Clue

FOR THE THIEF
A Pirate's Plunder is hidden in one of the underground chambers. Collect one diamond from each of the other players.
(To be used only once).

Clue

FOR THE PURSUER
In the Dining Room, if you press a certain leaf in the carpet, the chandelier will lower to reveal a way out. You may remove one of your characters free from the Dining Room at any time throughout the game.

Clue

FOR THE PURSUER
Rock the Hobby Horse in the nursery and you will find a clue. You may ask the character nearest to (but not already in) the inner circle to admit whether he is the thief.
This card may only be used once.

Clue

FOR THE PURSUER
Look for the revolving mirror in the Diamond Room, which will lead you to a treasure under Pan's statue in the Rose Garden.
Collect one diamond from each of the other players.
(To be used only once).

Clue

FOR THE PURSUER
We dub thee "Sir Diamonds".

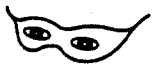

Sir Diamonds you are, forever and ever to follow your star.'
You may use this card throughout the game to remove one character at a time from the Diamond Room.

Clue

FOR THE PURSUER
Use this card to block the thief's escape when first he reaches the exit.
He must return to the first unoccupied space outside the inner circle.
(To be used only once).

FIG. 6A

Clue

FOR THE THIEF
In the Card Room, if you turn the right key in one of the cabinets, it will swing wide, revealing an exit. You may remove a character from the Card Room free. Throughout the game.

Clue

FOR THE THIEF
The lights go out just as you are about to be arrested.
Use this card to escape your pursuer the first time you are stopped.

Clue

FOR THE PURSUER
Touch a certain stone in the Courtyard and the Drawbridge will lower. You may take one free clue card whenever you wish.
(To be used only once).

Clue

FOR THE PURSUER
I will show you a quick way to the exit. Move any pair of your characters to the first space in the inner circle.
(To be used only once).

Clue

FOR THE PURSUER
You suspect the Butler of being an accomplice. You may require any character to move into the Dining Room, where you will be eavesdropping behind the screen.
(To be used once).

Clue

FOR THE PURSUER
Drawing room
The life-size portrait of the Silver Lady will open if you touch the right pearl in her necklace.
Your characters may leave this room free, one at a time, throughout the game.

Clue

FOR THE THIEF
Dance once more around the floor.
(Make one complete circuit).
(To be used only once).

Clue

FOR THE THIEF
Do not tarry in the inner circle! Danger waits there! When your pair of characters enters it, you may proceed to the last space before the exit.
(To be used only once).

Clue

FOR THE THIEF
Hurry a pair of your characters to the first space in the inner circle.
(To be used only once).

Clue

FOR THE PURSUER
Suit of Armour
If you touch the third finger on the left hand, the door in the shadows will unlock, showing how the thief plans to escape. You may challenge one character on an orange space to confess. If he is the thief, you have won the game. If not, pay two diamonds.
(To be used only once).

FIG. 6B

Harlequin

Since ancient times Black Onyx has been called the Witches' Mirror.

Roll one die and ask bank for that number of diamonds.
(Or) advance that number of spaces.

Harlequin

GEMINI — The Twins
May 20 — June 21

Gemini seeks idealistic love.

Stay where you are!

Harlequin

Hippona roman goddess of horses.

Roll two dice and advance that number of spaces.

Harlequin

PISCES — The Fish
February 20 — March 21

Pisces returns good for evil.

Roll two dice and advance that number of spaces.

Harlequin

THE YEAR OF THE OX
Oriental Horoscope

| | | |
|---|---|---|
| 1901 | OX | 1949 |
| 1913 | YEARS | 1961 |
| 1925 | 1937 | 1973 |

An Ox lives by the clock.

Hurry to the next pink space.

Harlequin

"According to ancient legend, witches have green eyes."

Hurry five spaces forward.

Harlequin

Shiva Hindu goddess of destruction.

Remove one of your characters from the dining room.

Harlequin

Marquee. Originally a shelter for a Marquise.

Remove one of your characters from the dining room.

Harlequin

It is lucky to wear a ring made of Elephant's hair.

Dance seven steps forward.

Harlequin

THE YEAR OF THE MONKEY
Oriental Horoscope

| | | |
|---|---|---|
| 1908 | MONKEY | 1956 |
| 1920 | YEARS | 1968 |
| 1932 | 1944 | 1980 |

Monkeys can be disorderly.

Swing nine spaces forward.

Harlequin

"All's well that ends well". William Shakespeare dance once more around the floor.

(Make one complete circuit).

FIG. 7A

Harlequin

Never store Shoes on a shelf above your head.

Remove one of your characters from the drawing room.

Harlequin

"Love whispers
in your ear,
there is one
you would be near."

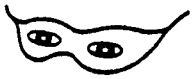

Dance to the next orange space.

Harlequin

Queen Elizabeth I often ate stewed eels for supper.

Dance to the next orange space.

Harlequin

If you dream of a Monk whose face is hidden, beware of a scheming relative.

Hurry six steps forward.

Harlequin

The nine of diamonds is an unlucky card. Known as the "Curse of Scotland".

Roll one die and pay that number of "diamonds".

Harlequin

A tilt is a medieval contest in which two horsemen thrust with lances in an attempt to unseat each other.

Hurry three steps forward.

Harlequin

When witches meet there is a whiff of incense and a circle drawn with a knife.

Hurry eight spaces forward.

Harlequin

"When I'm with you, it's deja-vu".

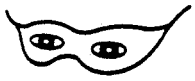

Dance to the next red space.

Harlequin

Jinx. A bird used in casting spells.

Roll one die and ask bank for that number of diamonds (or) advance that number of spaces.

Harlequin

"Sometimes the fooler is made the fool".

Dance once more around the floor.
(Make one complete circuit).

Harlequin

Some say that the "Man in the Iron Mask" was the brother of Louis XIV.

Go to the dining room (or pay one "diamond").

FIG. 7B

Harlequin

Some Witches can prepare a Love Potion to warm the coldest heart.

Hurry five steps forward.

Harlequin

"Too soon old and too late smart."

Roll one die and pay that number of diamonds.

Harlequin

Try Garlic or Holy Water to get rid of a Ghost."

Remove one of your characters from the diamond room.

Harlequin

The Romans burned Hazel Torches on Wedding Nights to ensure a blissful union.

Remove one of your characters from the card room.

Harlequin

Scrying is another word for Crystal Gazing.

Go to the drawing room (or pay one diamond).

Harlequin

Some people think they were born under a Malicious Moon.

Hurry three steps forward.

Harlequin

Cinderella hated housework!

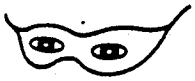

Dance nine steps forward.

Harlequin

TAURUS — The Bull
April 20 — May 19

Taurus has a strong love of family.

Dance to the next dark blue space.

Harlequin

THE YEAR OF THE SHEEP
Oriental Horoscope

| | | |
|---|---|---|
| 1907 | SHEEP | 1955 |
| 1919 | YEARS | 1967 |
| 1931 | 1943 | 1979 |

Sheep are amorous.

Dance to the next pink space.

Harlequin

When someone does an Irishman an injustice, he will say: "They'll have no luck for it."

Hurry one step backward.

Harlequin

Some say that Queen Elizabeth I exchanged lovers — knot rings with Lord Essex.

Dance once more around the floor. (Make one complete circuit).

FIG. 7C

Harlequin

Nimbus a bright cloud surrounding Gods or Goddesses when they appeared on earth.

Dance five steps forward.

Harlequin

LIBRA — The Scales
September 23 — October 22

Libra likes excitment.

Hurry one step forward.

Harlequin

Some say that Voodoo was rampant in the Paris of Louis XIV.

Hurry seven steps forward.

Harlequin

Some say that the Angel of Light walks beside the lucky ones.

Remove one of your characters from the drawing room.

Harlequin

"Silver and gold,
tales that are told,
souls that are sold,
for silver and gold."

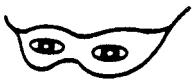

Hurry to the next dark green space.

Harlequin

Romeo was athletic!

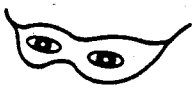

Dance to the next light blue space.

Harlequin

The Elizabethan theatre had no actresses. Women's roles were taken by boys recruited from choirs.

Dance two steps forward.

Harlequin

King Arthur's court Jester was called Sir Dagonet.

Dance seven steps forward.

Harlequin

THE YEAR OF THE COCK
Oriental Horoscope

| | | |
|---|---|---|
| 1909 | COCK | 1957 |
| 1921 | YEARS | 1969 |
| 1933 | 1945 | 1981 |

Cocks are reliable and brave.

Roll two dice and advance that number of spaces.

Harlequin

"Black powder, green flame, chants and incense, the Devil's game."

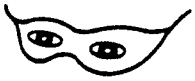

Roll two dice and ask Banker for that number of diamonds (or) advance that number of spaces.

Harlequin

SCORPIO — The Scorpian
October 23 — November 21

Scorpio is intense.

Hurry to the next dark blue space.

FIG. 7D

Harlequin

When is a bribe not a bribe? When it's Cumshaw on the China coast.

Dance eight steps forward.

Harlequin

Master Wace was a troubadour at the court of Henry II.

Dance five steps forward.

Harlequin

Black Madonnas are surrounded by legend and are said to have appeared in Miraculous circumstances.

Hurry three steps forward.

Harlequin

Smintheus. The Mouse-God.

Hurry to the next light green space.

Harlequin

Never let a Peacock Feather into your House!

Roll one die and ask bank for that number of "diamonds" (or) advance that number of spaces.

Harlequin

Students of Domino Lore refuse to consult them on Mondays or Fridays, claiming that those are bad days.

Hurry six steps forward.

Harlequin

Did you know that Chambertin was reputed to have been Napoleon's favourite tipple?

Dance three steps forward.

Harlequin

Some people are dealt the winning hand at birth.

Dance eight steps forward.

Harlequin

Sir Walter Raleigh married Bess Throckmorton maid of honour to Queen Elizabeth I.

Dance two steps forward.

Harlequin

THE YEAR OF THE TIGER
Oriental Horoscope

| | | |
|---|---|---|
| 1914 | TIGER | 1962 |
| 1926 | YEARS | 1974 |
| 1935 | 1950 | 1986 |

Tigers are lusty and passionate lovers.

Stay where you are!

Harlequin

THE YEAR OF THE RABBIT
Oriental Horoscope

| | | |
|---|---|---|
| 1915 | RABBIT | 1963 |
| 1927 | YEARS | 1975 |
| 1939 | 1951 | 1987 |

Rabbits are very sensitive.

Hurry one step backward.

FIG. 7E

Harlequin

If you help a stranded Mermaid back to the sea, she will grant you a wish.

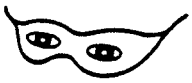

Dance four steps forward.

Harlequin

The Ouija has just spelled out the letters H - O - W - D - A - H does that mean anything to you?

Dance two steps forward.

Harlequin

Airmen always cross unused seat-belts before take off, so as not to offend the spirits of the unknown.

Stay where you are!

Harlequin

A "shade" is what remains of the Spirit of one who has unwillingly left this world.

Hurry one step backward.

Harlequin

A white feather on the doorstep is a Voodoo warning.

Hurry six steps forward.

Harlequin

The Chinese tell stories of Were-Tigers, Were-Cats and even Were-Crocodiles!

Stay "were" you are!

Harlequin

If you dream of a Panther someone is watching you.

Hurry to the next light blue space.

Harlequin

The Archangel Sachiel governs Thursday.

Go to the drawing room (or pay one diamond).

Harlequin

A Coven of Witches consists of Thirteen members.

Roll one die and pay bank that number of "diamonds".

Harlequin

CANCER — The Crab
June 21 — July 22

Cancer dwells in the past.

Hurry one step backward.

Harlequin

Napoleon was afraid of Cats.

Roll two dice and advance that number of spaces.

FIG. 7F

Harlequin

At Macumba meetings spirits are invoked, and a cauldron is stirred with a trident.

Hurry three spaces forward.

Harlequin

Queen Elizabeth received the first wrist watch as a New Year's gift in 1570.

Dance to the next brown space.

Harlequin

It is bad luck if an owl approaches the house.

Hurry one space forward.

Harlequin

Oriental Brides wear Red.

Dance to the next yellow space.

Harlequin

Magical wands should be cut at dawn.

Go to the diamond room (or pay two diamonds).

Harlequin

Domino. A loose cloak with wide sleeves, hood and mask, worn at masquerades.

Dance four steps forward.

Harlequin

AQUARIUS — The Water Carrier
January 21 — February 19

Aquarians have complex personalities.

Hurry five steps forward.

Harlequin

"Hurry past dark woodlands,
quiet in the night,
hurry fast, my darling,
lest you die of fright."

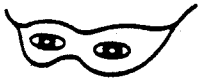

Run four spaces forward.

Harlequin

THE YEAR OF THE HORSE
Oriental Horoscope

| | | |
|---|---|---|
| 1906 | HORSE | 1954 |
| 1918 | YEARS | 1966 |
| 1930 | 1942 | 1978 |

Horses look well in silk clothing.

Dance two steps forward.

Harlequin

Harlequin — a comic character in pantomime, who wears a mask and spangled tights of many colours.

Dance once more around the floor.
(Make one complete circuit).

Harlequin

"Fugitive thoughts
caught in a web,
held for a moment,
before they are fled."

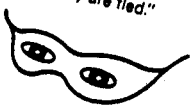

Go to the dining room (or pay one diamond).

FIG. 7G

Harlequin

Leo — The Lion
July 23 — August 21

Leo is brilliant.

Dance five steps forward.

Harlequin

"I wish I were a Jelly Fish that hasn't any cares."
G. K. Chesterton.

Go to the card room (or pay one diamond).

Harlequin

"It's the same the whole world over; It's the poor wot gets the blame, It's the rich wot gets the pleasure, ain't it all a bloomin' shame!"

Go to the diamond room.
(Or pay two diamonds).

Harlequin

Some say that a little Dancing Devil canters behind wicked persons.

Hurry nine spaces forward.

Harlequin

Capricorn — The Goat
December 22 — January 21

Capricorn is whimsical.

Roll two dice and advance that number of spaces.

Harlequin

Some say that Devil worshippers turn themselves into hares and run about at night.

Hurry to the next brown space.

Harlequin

Box number five in the Paris Opera House is haunted by the Phantom.

Hurry one step forward.

Harlequin

The rite of the Hank of Hair, the Nail Paring, the Wax Effigy, still exists.

Hurry one step backward.

Harlequin

"Stay within a lighted space, or you may vanish, without a trace."

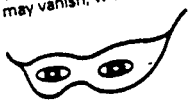

Roll two dice and advance that number of spaces, or ask bank for that number of diamonds.

Harlequin

THE YEAR OF THE RAT
Oriental Horoscope

| | | |
|---|---|---|
| 1912 | RAT | 1960 |
| 1924 | YEARS | 1972 |
| 1936 | 1948 | 1984 |

Rats are seductive.

Dance two spaces forward.

Harlequin

"Goblins Prance beneath a tree, round and round so merrily".

Dance once more around the floor. (Make one complete circuit).

FIG. 7H

Harlequin

Cleopatra was clairvoyant.

Dance once more around the floor.
(Make one complete circuit).

Harlequin

ARIES — The Ram
March 21 — April 19

Aries is irresistible!

Dance one space forward.

Harlequin

Hamlet talked too much!

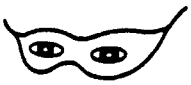

Dance nine spaces forward.

Harlequin

Mary Queen of Scots regarded Heresy a greater crime than Murder.

Hurry one step backward.

Harlequin

Sometimes when a maiden dies forsaken she returns to haunt her deceiver in the shape of a White Hare.

Hurry one step forward.

Harlequin

SAGITTARIUS — The Archer
November 22 — December 21

Sagittarius aims high.

Dance to the next dark green space.

Harlequin

The Four of Clubs is an unlucky card, called the "Devil's Bedposts".

Go to the card room (or pay one diamond).

Harlequin

VIRGO — The Virgin
August 22 — September 22

Virgo is curious.

Roll two dice and advance that number of spaces.

Harlequin

Never hang anything on a doorknob!

Hurry one step backward.

Harlequin

"Dancing dogs with ruffled collar, twirling round on tippy toes."

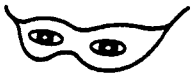

Hurry one space backwards.

Harlequin

THE YEAR OF THE DRAGON
Oriental Horoscope
1904 1916 1928 DRAGON YEARS 1940 1952 1964 1976

Dragons are ardent.

Dance four steps forward.

FIG. 7I

Harlequin

"Linger not
in places where
memories
could bring despair."

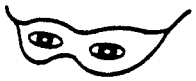

Hurry to the next yellow space.

Harlequin

"Never let a friendly fox into your henhouse, one day he is going to get hungry".

Roll one die and ask bank for that number of "diamonds" (or) advance that number of spaces.

Harlequin

"Beyond all time,
beyond all space.
Beyond all barriers,
where true love waits."

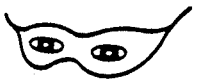

Remove one of your characters from the diamond room.

Harlequin

Vesta roman goddess of fire.

Hurry three spaces forward.

Harlequin

"Awesome spells that can be cast, mumbling secrets from the past".

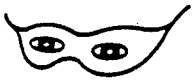

Roll one die and advance that number of spaces.

Harlequin

The Whitehorn Tree is a favourite of Leprechauns and to destroy one brings bad luck forever.

Hurry eight steps forward.

Harlequin

Some say that Dr. Lee, the 16th century magician, was called Queen Elizabeth's "Merlin".

Dance to the next light green space.

Harlequin

Fulgora Roman goddess of lightning.

Hurry nine steps forward.

Harlequin

THE YEAR OF THE DOG
Oriental Horoscope

| | | |
|---|---|---|
| 1910 | DOG | 1958 |
| 1922 | YEARS | 1970 |
| 1934 | 1946 | 1982 |

Dogs are wise.

Dance four spaces forward.

Harlequin

"Werewolves and vampires and banshees who wail."

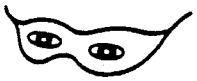

Hurry nine spaces forward.

Harlequin

Typhon, Egyptian God of evil.

Hurry six spaces forward.

FIG. 7J

Harlequin

Pages were known as Henchmen during Edward VI's reign.

Dance two steps forward.

Harlequin

The idea that it is wrong to awaken a Sleepwalker goes back to the primitive belief that to do so would prevent the Soul from returning.

Hurry one step forward.

Harlequin

"Demons and witches and devils with tails".

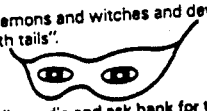

Roll one die and ask bank for that number of diamonds (or) advance that number of spaces.

Harlequin

Jackanapes was the nickname of a 15th century Duke of Suffolk.

Hurry seven spaces forward.

Harlequin

"Evil to him that evil thinketh."

Motto of the Order of the Garter.

Hurry four steps forward.

Harlequin

THE YEAR OF THE SNAKE
Oriental Horoscope

| | | |
|---|---|---|
| 1917 | SNAKE | 1965 |
| 1929 | YEARS | 1977 |
| 1941 | 1953 | 1989 |

You never quite know where you are with a Snake.

Roll two dice and advance that number of spaces.

Harlequin

Marie Antoinette was a talented spender.

Roll one die and pay that number of "diamonds".

Harlequin

If Napoleon had studied Numerology, he would have avoided the Battle of Waterloo.

March to the next red space.

Harlequin

"You won't need your Tiara when Tarzan invites you to his Tree-House."

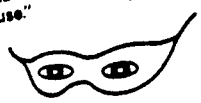

Remove one of your characters from the card room.

Harlequin

THE YEAR OF THE BOAR
Oriental Horoscope

| | | |
|---|---|---|
| 1911 | BOAR | 1959 |
| 1923 | YEARS | 1971 |
| 1935 | 1947 | 1983 |

Boars are flirtatious.

Roll two dice and advance that number of spaces.

Harlequin

"Suddenly the Frog begins his dance."

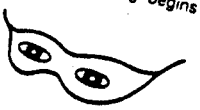

Leap into the first space in the inner circle. But, only a pair may use this card.

FIG. 7K

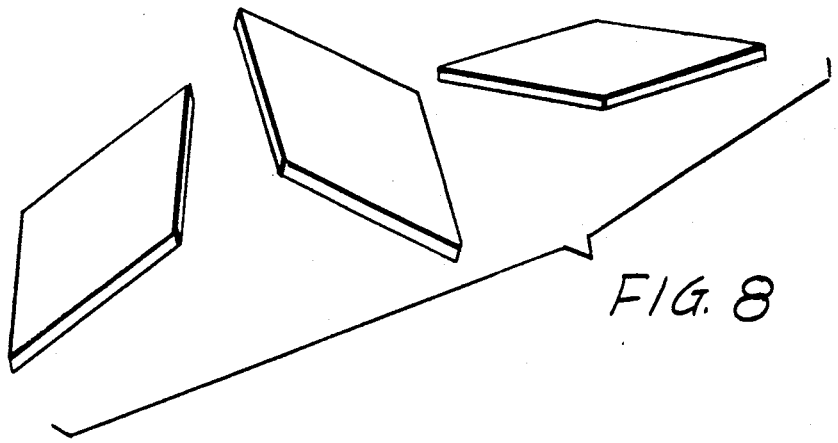
FIG. 8
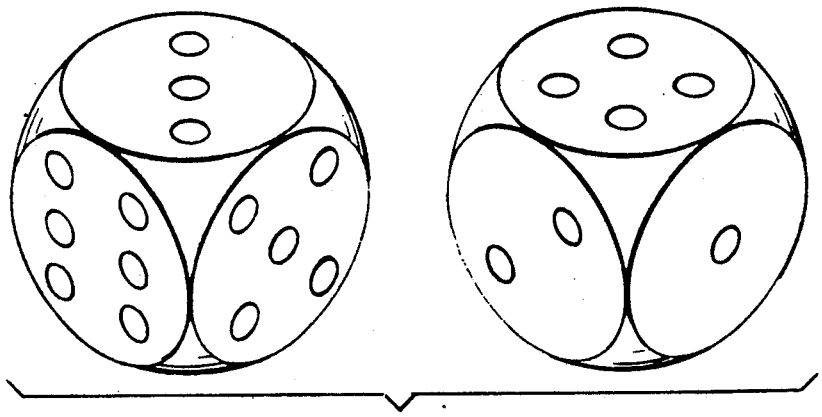
FIG. 9
FIG. 10
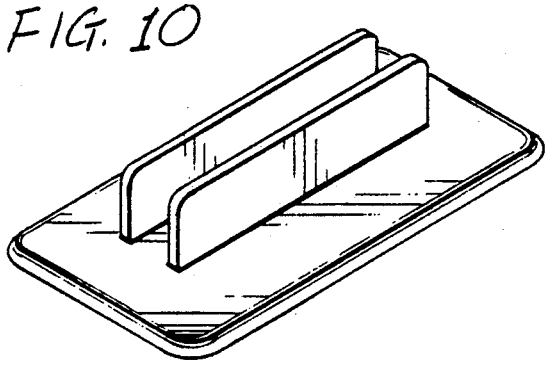

BOARD GAME TO CATCH A THIEF

BACKGROUND AND SUMMARY OF THE INVENTION

The invention relates to a parlor game for amusement and entertainment and more particularly to a new board game which combines the elements of skill and chance. Skillful use of playing position and playing cards against other players as well as the element of luck determines whether the daring jewel thief escapes and, therefore, wins the game or whether the thief is discovered before escape by an opposing player, the latter then winning the game.

A variety of board games have been well known and extremely popular for many years with both young and old alike. Such games as Monopoly (Darrow U.S. Pat. No. 2,026,082 issued Dec. 31, 1935) has been consistently popular over a long period of time. The game, of course, is related to the sale, purchase and rental of real estate in accordance with rules of the game and movement of the game pieces. Still others of a wide variety of prior art board games are well known of which the following are merely exemplary and not exhaustive: Airline Ownership and Travel Game to Escott U.S. Pat. No. 4,887,818 (1989); Travel Game Arrangement to Charney U.S. Pat. No. 4,629,195 (1986); Golf Board Game Apparatus to Bynam U.S. Pat. No. 4,108,442 (1978); Franchise Board Game to Rosenberg U.S. Pat. No. 4,027,882 (1977) and Board Game Apparatus to Malisow U.S. Pat. No. 3,889,954 (1975).

The game "Bal Masque" in accordance with my invention takes place at a masked ball held at a chateau in France. It is known that a priceless jewel has been stolen from a guest and that the thief is also a guest and has not yet escaped. The object of the game is to catch the thief before he or she escapes. If the thief manages to escape without being caught, he or she wins the game. Of course, if an opposing player catches the thief before he or she escapes, then that player is the winner.

The game according to my invention includes a board, the center of which represents the ballroom floor with multicolored spaces in the form of a progressive substantially spiral path about the board over which the player's masked characters are moved. Surrounding the ballroom floor on the board are four adjoining rooms which the characters may choose to visit or may be required to visit while at the ball. The game apparatus, in addition to the board and player characters, includes five sets of cards (121 Harlequin, 24 Suspect, 21 Clue, 11 "One Who Knows", as well as 5 Thief cards); twenty-four character playing pieces (assigned in pairs to the players); as well as diamond shaped tokens (used as currency) and two dice.

The Thief cards are used to inform one of the players that he or she will be moving the thief. The Suspect cards are distributed to the players and in the case of the player moving the thief, that player is informed by the card which specific character has been designated as the thief. As to the other players, the Suspect card simply indicates which character must be brought into play first. The player declared the "One Who Knows" as determined at the beginning of the game by that player rolling the highest number on the dice is, among other things, the banker, and the player designated to distribute the cards. Additionally, such a player may select for himself alone a single "One Who Knows" card and may without disclosing its message at the time of drawing, use it during the course of a game.

Harlequin cards are distributed nine at a time face down to each of the players and are turned over and read aloud one at a time in the course of play. It is these cards which generally direct the play of the game by directing the player forward or backward on the ballroom progressive path or directing the player to roll one or both dice for a particular purpose. Additionally, such cards may be sold under certain conditions and may additionally contain special indicia which would affect the value of the cards with regard to the players.

As aforementioned, the game additionally includes Clue cards which may be purchased one at a time by any of the players as an alternative to taking a Harlequin card at their normal turn. Such cards, however, may not be used until a later turn, and the purchase of such cards is at the buyer's risk. That is to say, instructions on the card, although not read aloud until used, may be for the benefit of the thief or may be for the benefit of the other players.

During the course of a game the objective for the player moving the thief is to move the thief character to the center space of the ballroom floor without being caught. Said center space leads to freedom for the thief through dungeons to a secret tunnel under the moat and thus freedom. Under such circumstances, the thief obviously wins the game. However, if an opposing player catches the thief before an escape is made, that player is declared the winner. As the player moving the thief, a decision regarding strategy must be made as to whether to strike out boldly for the center space and thus run the risk of alerting the other players to the thief's identity or to employ a different strategy involving false leads and the like for the purpose of confusing the other players. As to the player designated the "One Who Knows", the strategy is to decide whether to use the special card early, hoping to gain a clue as to the thief's identity, or to use the special card later in the game when it may be of considerable help in catching the suspected thief. As a player, the essence of a winning strategy lies in the ability to discern an opposing player's tactics without betraying your own.

Accordingly, it is the primary object of the present invention to provide a parlor game with a winning strategy which involves the skillful utilization of playing position and playing cards against other players in such a manner as to require reliance on the elements of both skill and chance.

BRIEF DESCRIPTION OF THE DRAWINGS

These as well as other objects and advantages of this invention will be more completely appreciated by carefully studying the following detailed description of a presently preferred exemplary embodiment of this invention in conjunction with the accompanying drawings in which:

FIG. 4 represents a set of eleven "One Who Knows" cards containing special messages or instructions to be used only by the "One Who Knows";

FIGS. 6A and 6B represent twenty-one Clue cards containing messages which may be helpful to either the thief or the pursuers;

FIGS. 7A through 7K illustrate 121 Harlequin cards which provide instructions for the purpose of directing the movements of the board characters by the players;

FIG. 8 illustrates diamond shaped tokens used as currency in the game;

FIG. 9 illustrates the dice used in accordance with instructions found on the Harlequin cards; and FIG. 10 illustrates in perspective a base of the nature shown in FIGS. 2A through 2D which is used with the masked ball characters.

DETAILED DESCRIPTION OF THE DRAWINGS

Figure 1A:
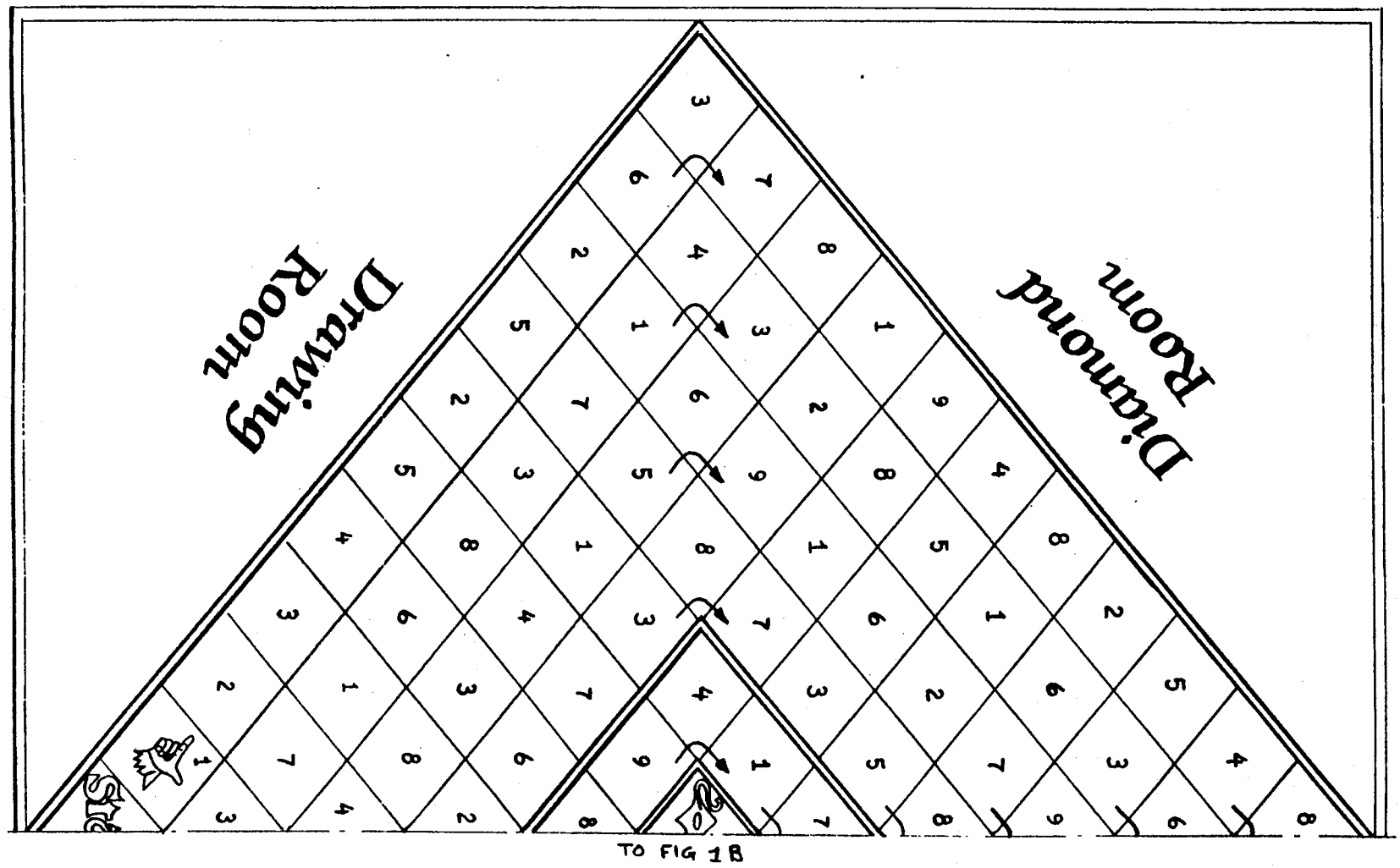
FIGS. 1A and 1B illustrate a plan view of an exemplary game board in accordance with the present invention.
Figure 1B:
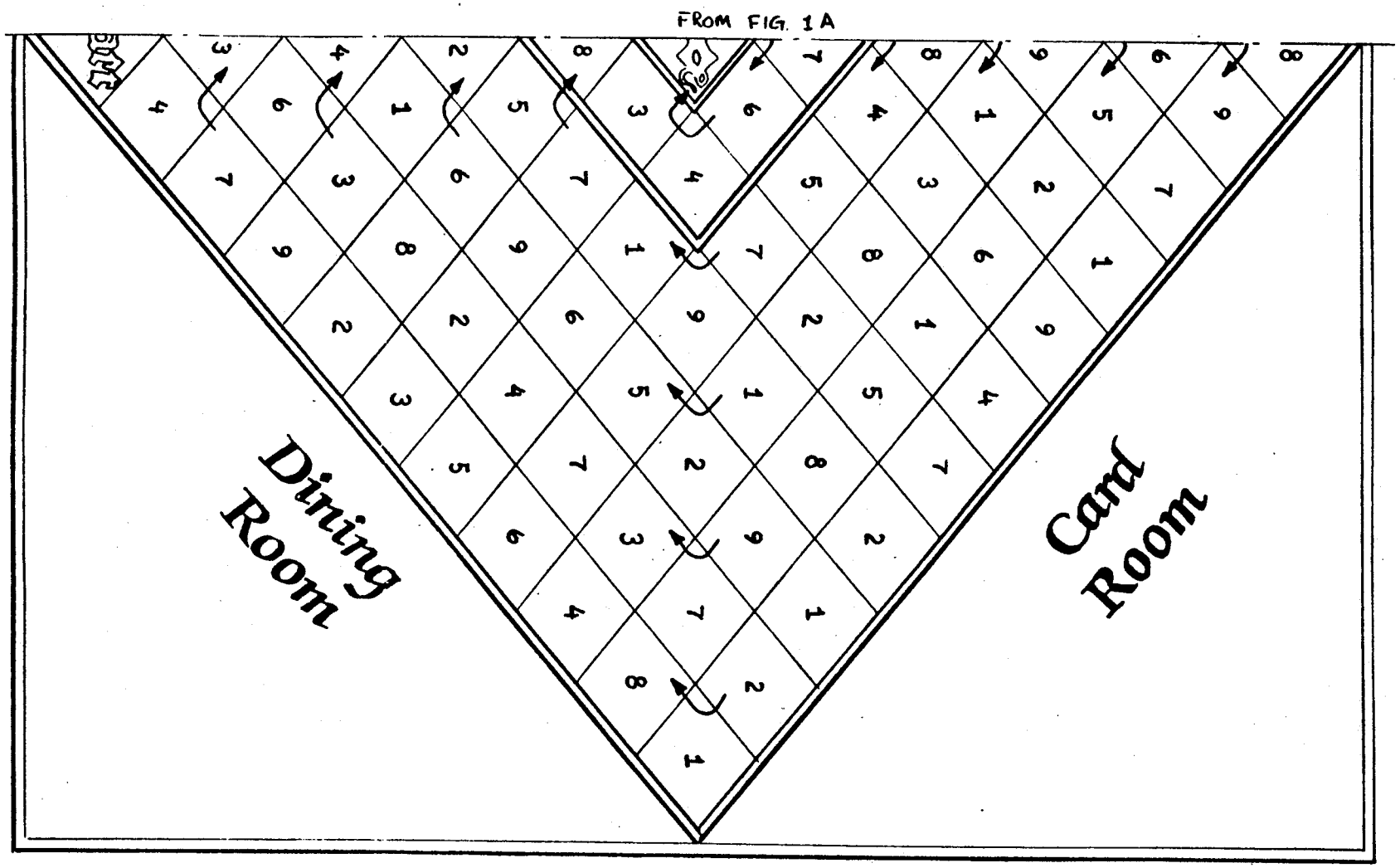
Figure 2A:
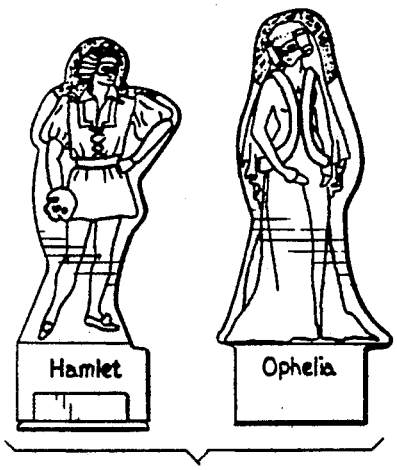
FIGS. 2A through 2D each illustrate one exemplary pair of twelve pair of well known characters which serve as game pieces to be moved by the players.
Figure 2B:
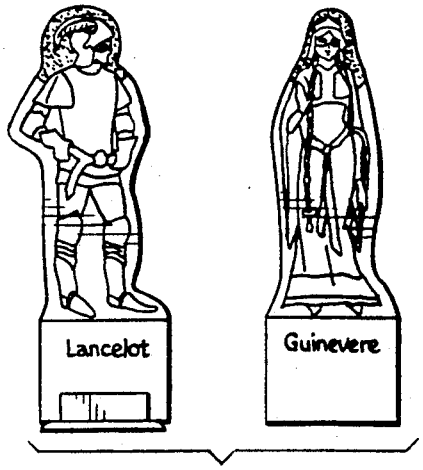
Figure 2C:
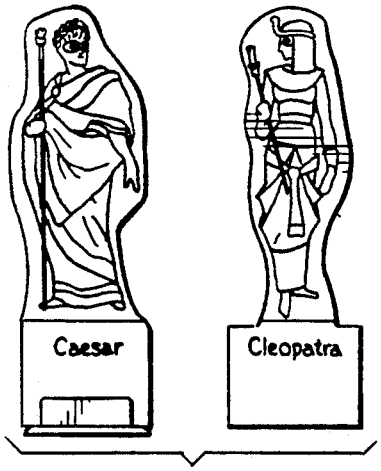
Figure 2D:
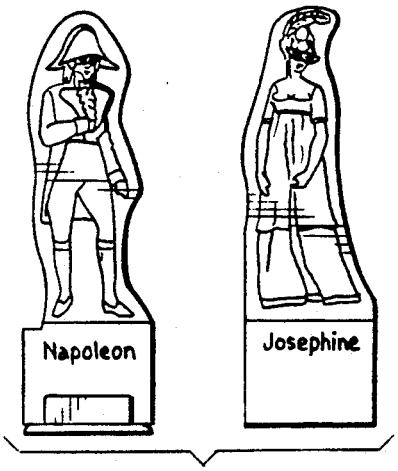
Figure 3:
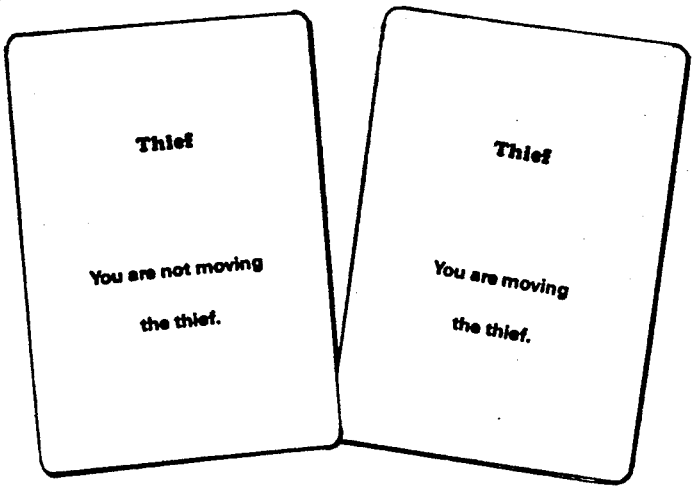
FIG. 3 illustrates two of five Thief cards.

As illustrated in FIGS. 1A and 1B, the physical environment of the game takes place on a board representing the ballroom floor with spaces layed out in a progressive path over which the masked ball characters are moved by the players. Although, as illustrated, the progressive path spaces forming the ballroom floor are numbered, the numbers are representative of colors as follows:

1 - Pink
2 - Dark Green
3 - Orange
4 - Light Green
5 - Yellow
6 - Light Blue
7 - Red
8 - Dark Blue
9 - Brown Additionally, as illustrated on the board, the ballroom floor is surrounded by adjoining rooms labelled in a clockwise fashion: Diamond Room, Card Room, Dining Room and Drawing Room. The characters while at the ball may visit these adjoining rooms singly or in pairs at the direction of the players or as commanded by the Harlequin cards or Clue cards. Also associated with the board are twelve pairs of well known characters which serve as game pieces to be moved by the players. FIG. 2A, for example, illustrates a first well known pair such as Ophelia and Hamlet; whereas, FIG. 2B would include Lancelot and Guinevere. FIG. 2C includes the pairing of Caesar and Cleopatra; whereas, FIG. 2D pairs Josephine with Napoleon. In addition to being logically paired, the contemplated twelve pairs are color coded into four groups of three pair each through the use of common colored backgrounds or clothes. Additionally, it is to be noted that the characters as illustrated in FIGS. 2A and 2B include speckled halos about the heads and shoulders which may be used for identification purposes in assigning characters to players when the game is played by five or six players and requires more than four groups of characters. Furthermore, some of the famous characters illustrated have been illustrated with bases which may be placed on each character supplied with the game for holding them in the upright or standing position for placement on the board. Although only four of the contemplated twelve pair of well known characters have been illustrated, the remaining eight pair would be similar in nature. For example, it is contemplated that the following pairings would be included in the disclosed exemplary embodiment:

Romeo and Juliet
Queen Elizabeth I and Lord Essex
Pierrot and Pierrette
Cinderella and Prince Charming
Prince Albert and Queen Victoria
Pompadour and Louis XV
Quasimodo and Esmeralda
Nell Gwynn and Charles II Also included in the game equipment are five sets of cards comprising 121 Harlequin cards, 24 Suspect cards, 21 Clue cards, 11 "One Who Knows" cards and 5 Thief cards. There are two types of Thief cards as illustrated in FIG. 3. Four of the Thief cards indicate to the players receiving said cards that they are not moving the thief; whereas, one of the five Thief cards would be used to inform one of the players that he is moving the thief.

One of the players, as determined by the highest number produced when each player in turn rolls the dice, is designated the "One Who Knows". Such a designated player is the banker as well as the dealer. Although the "One Who Knows" cannot be designated as the player moving the thief when the game is played by 2, 4, 5 or 6 players, this designated player may select a single "One Who Knows" card, which, as indicated in FIG. 4, may contain special messages or instructions to be used only by the "One Who Knows". Such a specially designated player may look at the card when selected and use it immediately or view the card, not disclose its message and use it later in the game. Such a decision is part of the game strategy and is a skill element which may greatly affect the outcome of the game. That is to say, the "One Who Knows" must decide whether to use the special card early hoping to gain a clue as to the identity of the thief or later in the game when it may help to catch the suspected thief.

Figure 5:
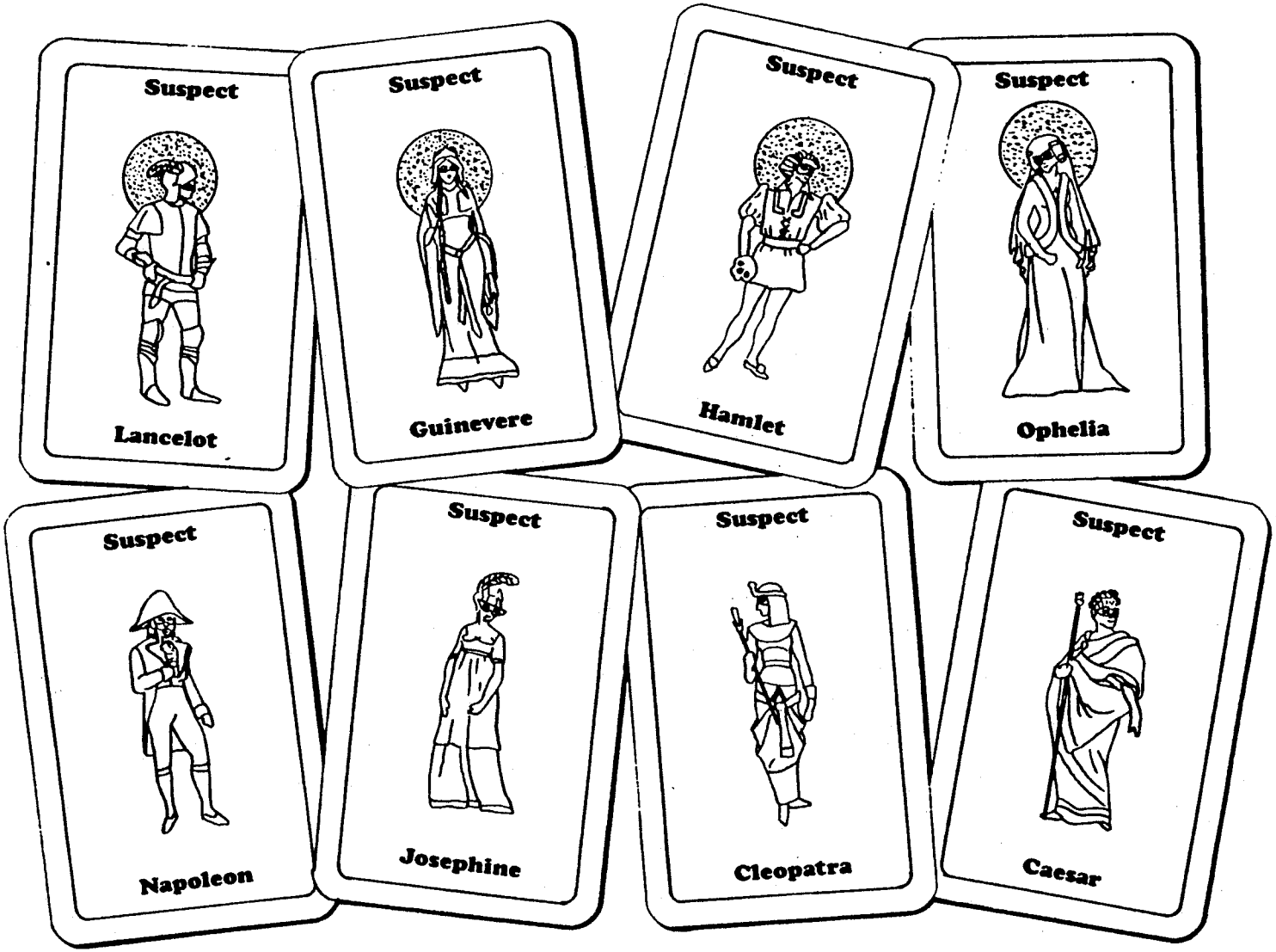
FIG. 5 illustrates four pair of a total of twelve pair of suspect cards which show the same characters as are included in the game pieces of FIGS. 2A through 2D.

Although the game may be played by from two to six players, the exemplary embodiment will be explained in terms of the game as played by four players. In preparing for such a game the several players shuffle the Harlequin cards, the Clue cards and the "One Who Knows" cards which are placed face down at the side of the board. The twenty-four Suspect cards which are matched by character as well as color with the twelve pair of game piece characters are sorted by color and placed face down at the side of the board. FIG. 5 illustrates a representative four of the twelve pair of Suspect cards.

As aforementioned, the Suspect cards and the characters are matched such that each of the twenty-four characters used as playing pieces are reproduced on the twenty-four Suspect cards. Four subsets of the characters and Suspect cards are identified by color coding the background of three pair of characters as well as the borderline of the Suspect cards containing the same three pair of characters with the same color. Thus, four sets of three pairs of characters are obtained. Still further subsets of character pairs may be obtained by using two or four of the character pairs and Suspect cards containing speckled halos about the head and shoulders of the characters.

Once the Suspect cards have been sorted by color and placed face down, each player in turn rolls the dice, and the player with the highest number is declared the "One Who Knows" and the banker. Starting from the left of the "One Who Knows", the players choose the character playing pieces whom they wish to represent them at the ball. In a game involving four players each player selects three pairs of characters all of the same color with the "One Who Knows" choosing last.

Three Thief cards including one "You are Moving the Thief" and two "You are Not Moving the Thief" inscriptions are dealt by the "One Who Knows" to the other players who examine their cards secretly without revealing whether or not they are moving the thief. Thereafter, each player (including the "One Who Knows") draws one Suspect card matching the color of his characters. For the player assigned the task of moving the Thief the Suspect card informs that player alone of the identity of the thief who is attempting to escape from the ball by way of the progressive path leading to the center square of the board. As to the other players, the Suspect card simply indicates which of the several characters assigned to that player must be brought into play first.

The "One Who Knows" deals each player including himself nine Harlequin cards face down and, thereafter, deals further hands on an as-needed basis. Additionally, when all of the cards have been used, the "One Who Knows" gathers, shuffles and re-deals the cards. As aforementioned, the "One Who Knows" may also choose a single "One Who Knows" card which is for his or her use only. The designated player may look at the card and disclose its message or may refuse to disclose its message and set the card aside for use later in the game.

Diamonds, as illustrated in FIG. 8, are used as currency in the game. At the beginning of the game the "One Who Knows" gives each player including himself ten diamonds. During the course of the game, the "One Who Knows" also acts as the banker for the diamond-shaped tokens and takes special care to segregate his personal funds from those of the bank. The reserve diamonds should be kept in the Diamond Room.

FIGS. 7A through 7K illustrate the Harlequin cards which after shuffling are left face down to be turned over and read aloud one at a time in the course of play. Although players upon reading a card which appears to be potentially quite valuable may not save it for later use, they may sell it to another player for a diamond or sell it to the highest bidder where more than one player bids for the card. As will be noted from a review of the Harlequin cards illustrated in the drawings, some include a Horoscope. If the Horoscope is not the birth sign of the player possessing the card, that player will offer it to opposing players whose sign matches. If the card is wanted, the claimant pays one diamond and claims the card as his own. The turn then reverts to the buyer who plays the purchased card. Where more than a single bidder for a Horoscope is present, the card again may be sold to the highest bidder. Still further, it will be noted that some of the Harlequin cards are marked with a mask. If a player should turn over three "Masked" cards in succession, an extra turn is accorded to that player.

FIG. 6A and 6B illustrate twenty-one Clue cards containing messages which may be helpful either to the thief or the pursuers. Such cards may be bought one at a time for three diamonds each by any of the players including the "One Who Knows" in place of a Harlequin card at their normal turn. The card, however, may not be used until a later turn. As aforementioned, some of the Clue cards benefit the thief, while others benefit the pursuers. Accordingly, players buy such cards at their own risk. The instructions on purchased cards need not be read aloud until used, and even then players need not reveal whether the card helps the thief or the pursuers.

After the above noted preliminary steps are exercised, the game is started with each player placing one pair of characters near the start with the other pairs scattered either separately or together in the Dining Room, Drawing Room or Card Room. The Diamond Room is normally avoided since removal of a character from any room requires payment in diamonds, and the cost associated with leaving the Diamond Room is twice as high as the other rooms. Play commences with each player in turn moving a pair of characters onto the ballroom floor. The player moving the thief need not start with the thief. However, the other players must start with the pair of characters which includes the one named on the drawn suspect card.

Characters are moved beginning at the "start" space (which counts as the first space) and follow the arrows of the generally spiral shaped progressive path leading to the center space. The first two characters used by each of the players start as a pair. However, later in the game the characters may enter or leave the ballroom individually so long as when they return they always return to their partner.

Further movement of the characters is controlled in accordance with instructions found on the Harlequin cards which may be applied to an individual character or a pair of characters if they are moving together. When a player has more than one character from different pairs or more than one pair on the ballroom floor, the player is free to choose which character or pair is to be moved in accordance with the card instructions. However, the move may not be split or divided between or among characters.

Additional movement rules also apply. For example, when following the directions on the cards, a character lands on an orange (No. 3) space, that player gets an extra turn. Additionally, although characters remain in the several rooms adjoining the ballroom floor until directions are received for them to leave, upon leaving a room a character either waits at "start" or rejoins his partner on the floor. Characters may also be removed from a room upon the payment of a fee, such as two diamonds and a turn in order to free a character from the Diamond Room or one diamond and a turn to remove a character from the other rooms. Should the player desire to remove a pair from a room, the cost in diamonds is doubled. However, only one pair per turn may be removed from a room by a player.

Alternatively, if a player is in need of more diamonds during the course of play, they may be obtained from the bank by placing one or more characters in the rooms. Two diamonds are obtained from the bank for each character placed in the Diamond Room, and one diamond is received for each character placed in the other rooms. No diamonds, however, are received when the player is directed by the cards to place a character in the rooms.

During the course of the game the thief may be apprehended either by catching a Suspect on the ballroom floor or in one of the rooms. For example, a player may challenge the identity of a character as to whether it is the thief when that character lands on his space. However, a false accusation will require two diamonds in restitution to the accused. Furthermore, if a pair of characters lands on the occupied space, only one may be challenged, and whether challenged or not, the original occupant must go back to the next free space on the progressive path. A player may also challenge if one of his characters is alone in a room with a Suspect. The "One Who Knows", however, may challenge a Suspect even if other characters are present in the room. Here again, a false accusation will cost two diamonds.

Diamonds obviously permit players to barter for an advantage throughout the game. An example would be a player offering a sum of diamonds to an opposing player (before the latter looks at his next Harlequin card) for the purpose of extracting a promise that said opposing player will not on the present turn challenge any of the former's characters. Additionally, an offer to buy another player's Harlequin card after he has read it aloud may be made. If the offer is accepted, however, the buyer must play that card on his next turn. Another example of the element of skill pertaining to bartering with diamonds would be where a player sells unused Clue cards in exchange for a negotiated price in diamonds. Clearly, it is a desirable skill element to use the diamonds wisely as part of a winning strategy in any manner which would not contravene the rules. Where in the course of a game a player for whatever reason finds himself unable to raise enough diamonds to continue to play that player must withdraw from the game unless another player is willing to loan diamonds on mutually agreeable terms.

As previously noted, the strategy of the game involves elements of skill as well as chance with the player moving the thief, for example, being required to decide whether or not to strike out boldly for the center space, thus running the risk of alerting the other players as to his identity. Alternatively, such a player may chose deceptive maneuvers in order to confuse the pursuers. The "One Who Knows", on the other hand, must decide whether to use the special card early in the game in order to obtain a clue as to the thief's identity or to employ it later in the game when it may aid in catching the Suspected thief.

Suspense in a well played game is heightened when characters attempt to enter the "inner circle" or last group of spaces surrounding the center space since special rules apply. For example, characters must be together as a pair in order to step into the inner circle and must remain together while inside. If one of a pair is required to leave its partner, the remaining partner must move back to the first unoccupied space outside the inner circle. Additionally, when exiting the inner circle (and winning the game) the pair of characters including the thief must have instructions to move the exact number of spaces that are required to reach the center space.

Although the foregoing rules apply to the preferred exemplary embodiment wherein four players are involved in the game, as previously noted, the game may be played by as few as two players or as many as six. As to the game as played by two players, it begins in the same manner noted above except that after the highest roll of the dice determines the player who is the "One Who Knows" the other player is automatically moving the thief. In light thereof Thief cards are not needed. However, to enable the thief to be more elusive, the player moving the thief will be allowed to select an additional three pairs of characters so that he will be moving a total of six pairs; whereas, the "One Who Knows" will only move three pairs of characters. Additionally, the player moving the thief will chose two suspect cards matching the colors of his characters. One of these will be secretly retained in order to name or designate which character is the thief. All other rules as recited, supra, are the same.

Where the game involves three players, the "One Who Knows" has no special advantage because he or she may be moving the thief. Accordingly, the "One Who Knows" does not draw a "One Who Knows" card and may not challenge characters in rooms when others are present. The game is begun in the manner noted with regard to the game as played by four players except that all players including the "One Who Knows" draw a theft card. Accordingly, as aforementioned, the "One Who Knows" may be moving the thief. All other rules are the same.

As to the game as played by five players, each player will select only two pairs of characters using those with speckled halos about the head and shoulders to create a fifth set. The excess or unused suspect cards are removed, and the "One Who Knows" deals four thief cards including the one labelled "You Are Moving The Thief" to the other players. Otherwise, the rules are the same as for a four player game.

With regard to the game as played by six characters, in this version each player again selects only four characters using the characters with speckled halos to create two different sets of characters. The suits of suspect cards are adjusted accordingly, and the "One Who Knows" deals five thief cards to the other players. Otherwise, the rules are the same as in a four player game.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A board game apparatus for a number of participants, said apparatus comprising:

a game board including a plurality of marked spaces interconnected in a spiral path of progression around said board;

a plurality of marked board sections located adjacent portions of said path of progression;

a plurality of pairs of movable game character pieces for movement singly or in pairs along said path as well as to and from the marked sections of the board, at least two pair of character pieces being assigned to each player for movement;

a first set of chance elements operated by the players wherein only one of said chance elements comprising indicia representing a special status, while the other chance elements of said first set having no indicia representing a special status, said chance elements comprising said special status indicia designating that one of the character pieces assigned to one of the players has a special status, said special status being known to at least said one of said players;

a second set of chance elements for directing the players to move at least one character piece in a particular manner;

a third set of chance elements which is selected by any player as an alternative to said second set of chance elements, whereby the directions furnished by said third set of chance means is optionally used or not used by the selecting player;

fourth chance elements, which is selectively used by a specially designated player to obtain a message contained thereon, wherein the message is selectively used in an attempt to discover the identity of the character piece having a special status; and fifth chance means operated by the players to determine said specially designated player.

2. The apparatus of claim 1 wherein said board path is representative of a ballroom floor at a masked ball, said character piece pairs are representative of well know pairs of persons, and said special status is representative of declaring one of the character pieces a jewel thief who is attempting to reach the center space of the board before being caught by another player.

3. The apparatus of claim 1 wherein said second, third and fourth chance elements are sets of cards used by the players in the operation of said game board apparatus.

4. The apparatus of claim 1 wherein said first chance elements are dice.

5. The apparatus of claim 1 wherein said fifth chance means is another set of cards.

6. The apparatus of claim 1 further including currency means to be exchanged by the players upon a character entering or leaving said marked board sections unless otherwise directed by said second, third or fourth chance elements.

7. The apparatus of claim 6 wherein said currency means includes diamond shaped tokens.

8. A board game apparatus comprising:

a game board including a plurality of marked spaces interconnected in a spiral path of progression around said board;

plural movable game character pieces for movement along said path wherein each player is assigned more than one character piece for movement;

a first set of chance elements operated by the players wherein only one of said chance elements comprising indicia representing a special status, while the other chance elements of said first set having no indicia representing a special status, said chance elements comprising said special status indicia designating that one of said character pieces assigned to one of the players has a special status, said special status being known to at least said one of said players;

a second set of chance elements for directing the players to move at least one character piece in a particular manner;

a third set of chance elements which is selected by any player as an alternative to said second set of chance elements, whereby the directions furnished by said third set of chance means is optionally used or not used by the selecting player;

fourth chance means which is selectively used by a specially designated player to obtain a message contained thereon, wherein the message is selectively used in an attempt to discover the identity of the character piece having a special status; and fifth chance means operated by the players to determine said specially designated player.

9. A board game apparatus as in claim 8 wherein said character pieces are associated in pairs by indicia means and plural pairs are assigned to each player for movement on said board singly or in pairs, and wherein said board game can accommodate between two and six players, inclusively.

10. A board game apparatus as specified in claim 8 further including:

a plurality of marked board sections located adjacent portions of said path of progression, wherein said character pieces in addition to being movable along said path of progression by the players are also movable to and from the marked sections of the board at the option of the assigned player or as directed by said second or third sets of chance elements.

11. A game board apparatus as specified in claim 10, wherein said path of progression spaces are color coded.

12. A game board apparatus as specified in claim 10 further comprising:

currency means to be exchanged by the players upon a character entering or leaving said marked board sections unless otherwise directed by said second or third chance elements.

13. The board game apparatus of claim 8 wherein said board path is representative of a ballroom floor at a masked ball, said character pieces are representative of well known persons, and said special status is representative of declaring one of the character pieces a jewel thief who is attempting to reach the center space of the board before being caught by another player.

14. A board game simultating a masked ball held in a chateau wherein the game object is for a jewel thief attending the ball to remain unknown until escape is accomplished, and for the remaining masked characters to identify and apprehend the thief prior to escape, said game comprising:

a board having a central section with a plurality of color coded spaces interconnected in a substantially spiral path of progression around the board;

a plurality of board sections simulating chateau rooms adjoining said central section of the board;

a plurality of pairs of movable game characters pieces for movement by the players singly or in pairs along the path of progression as well as to and from said a joining board sections simulating chateau rooms, at least two pair of character pieces being assigned to each player for movement;

a first set of chance elements operated by the players wherein only one of said chance elements comprising indicia representing a special status, while the other chance elements of said first set having no indicia representing a special status, said chance elements comprising said special status indicia designating that one of said character pieces assigned to one of the players is said jewel thief disguised as a well known character, the identity of the thief being known to at least said one of said players;

a first set of instruction means for normally directing the players in turn to move at least one character piece in a particular manner;

and a second set of instruction means which is selected by any player as an alternative to said first instruction means.

15. The game of claim 14 further comprising:

a third set of instruction means which is selectively used only by a specially designated player, whereby the directions contained in said third instruction means aids in identifying or apprehending the thief; and second chance means operated by the players to determine said specially designated player.

16. The game as specified in claim 15 further comprising:

currency means to be exchanged by the players upon a character piece entering or leaving said adjoining board sections unless otherwise directed by said first, second or third instruction means.

17. The game as specified in claim 16, wherein said currency means is used by the players to purchase members of said first and second instruction sets.

18. The game of claim 17 wherein said currency means includes diamond shaped tokens.

* * * * *